US008333235B2

(12) United States Patent
Chang et al.

(10) Patent No.: US 8,333,235 B2
(45) Date of Patent: Dec. 18, 2012

(54) HEAT DISSIPATION SYSTEM WITH A PLATE EVAPORATOR

(75) Inventors: Yen-Ming Chang, Hsinchu (TW); Kuo-Hsiang Chien, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 1168 days.

(21) Appl. No.: 12/044,764

(22) Filed: Mar. 7, 2008

(65) Prior Publication Data

US 2008/0283223 A1 Nov. 20, 2008

(30) Foreign Application Priority Data

May 16, 2007 (TW) ..... 96117477 A

(51) Int. Cl.
*H05K 7/20* (2006.01)

(52) U.S. Cl. ..... 165/104.26; 361/700

(58) Field of Classification Search ..... 165/104.26
See application file for complete search history.

(56) References Cited

U.S. PATENT DOCUMENTS

| | | | | |
|---|---|---|---|---|
| 3,543,839 | A * | 12/1970 | Shlosinger | 165/274 |
| 4,312,402 | A | 1/1982 | Basiulis | |
| 6,330,907 | B1 * | 12/2001 | Ogushi et al. | 165/104.26 |
| 6,381,135 | B1 * | 4/2002 | Prasher et al. | 361/700 |
| 7,007,746 | B2 * | 3/2006 | Wu et al. | 165/104.26 |
| 2004/0206480 | A1 * | 10/2004 | Maydanik et al. | 165/104.26 |
| 2006/0272798 | A1 * | 12/2006 | Liu et al. | 165/104.33 |
| 2007/0187072 | A1 * | 8/2007 | Chin et al. | 165/104.26 |
| 2008/0078530 | A1 * | 4/2008 | Chang et al. | 165/104.26 |
| 2008/0128898 | A1 * | 6/2008 | Henderson et al. | 257/713 |
| 2010/0018678 | A1 * | 1/2010 | Siu | 165/104.26 |

FOREIGN PATENT DOCUMENTS

| | | | |
|---|---|---|---|
| CN | 1703142 | A | 11/2005 |
| JP | 2006-125783 | A | 5/2006 |

* cited by examiner

*Primary Examiner* — Allen Flanigan

(57) ABSTRACT

A heat dissipation system is provided. The heat dissipation system includes: an evaporator having a plate chamber with the wick structures which has a plurality of pore sizes arranged in the plate chamber, a condenser, a vapor line, and a liquid line. The two-phase circulation of the vapor-condensate in the heat dissipation system, especially in the heat dissipation system with a plate evaporator, can effectively increase the heat conductivity of the plate heat source such as electronic chip. The design and composition of the wick structures are enormously decreased the turning-on temperature of the heat dissipation system and maintained the heat dissipation system in the balancing state under the low heat source power.

17 Claims, 11 Drawing Sheets

A−A

A−A

HEAT DISSIPATION SYSTEM WITH A PLATE EVAPORATOR

FIELD OF THE INVENTION

The present invention relates to a heat dissipation system. In particular, the present invention relates to a heat pipe dissipation system with a plate evaporator.

BACKGROUND OF THE INVENTION

Thermal management is an issue which is essential in all kinds of categories, such as permafrost stabilization, electronic equipment cooling, and aerospace, etc. Heat pipe is a common application means in plenty of thermal management methods. Heat pipe is a two-phase heat conduction device, which can conduct heat with high efficiency and effectively.

Please refer to FIG. 1, which is a structural diagram showing a traditional heat pipe device in accordance with the prior art. In FIG. 1, the heat pipe 1 is mainly configured by the tube 11, the wick structure 12 and the end caps 13. The interior of the heat pipe 1 is maintained in a low-pressured situation, and the adequate amount of the low-boiling point liquid 181 is injected in the interior thereof. The liquid evaporates easily because of its low boiling point. The wick structure 12 is configured by a capillary porous material, and is attached in the internal sidewall of the tube 11. One end of the heat pipe 1 is the evaporating end 151, and the other end thereof is the condensing end 152. When one end of the heat pipe 1 is heated, the liquid in the capillary tube evaporates quickly as the high-pressured vapor 182. The vapor 182 flows to the other end of the heat pipe 1 under the pressure gradient, and releases the heat to condense as the liquid 181 de novo. Then the liquid 181 flows to the evaporating end 151 along the capillary porous material by the action of the capillary force again. The circulation repeats infinitely, and the heat can be transported from one end of the heat pipe 1 to the other end thereof. The circulation proceeds fast, and the heat can be conducted continuously.

The wick structure of the traditional heat pipe is distributed in the inner surface of all the heat pipe, and the cell size of the wick structure thereof is limited. Although the capillary force can be increased because of the small cell size, at the same time, the resistance of liquid flow is also increased. This contradictory causes a barrier in increasing the performance of the traditional heat pipe. Meanwhile, the limitation of the capillary force also causes the limitation of the length of heat pipe. In addition, since the wick structure of the traditional heat pipe is configured in the inner surface of all the heat pipe, the vaporization is formed in the inner surface thereof when the heat pipe is heated. When the applied heat load or the wall temperature becomes excessively, boiling of the liquid in the wick structure may occur. The vapor bubbles generated inside the wick structure may block the liquid return paths and the wick can dry out.

In order to overcome the drawbacks of the abovementioned traditional heat pipe, a modified loop heat pipe is developed in recent years. The vapor line and the liquid line are designed as a loop. Please refer to FIG. 2(A) and FIG. 2(B), which are structural diagrams showing a loop heat pipe device in accordance with the prior art. In FIG. 2(A), the heat pipe 2 includes the evaporator 21, the condenser 23, the compensation chamber 25, the vapor line 231 and the liquid line 233. Among these, the evaporator 21 is a cylinder tube, and the interior of the evaporator 21 includes a sidewall 210, the primary wick structure 211, the secondary wick structure 212 and the non-wick flow path 214. The sidewall 210 toward inside is a grooved shape, and the axial vapor channel 213 is formed in the linkage between the primary wick structure 211 and the sidewall 210. The liquid line 233 is referred to as the bayonet, which directs the liquid all the way to the closed end of the evaporator 21. After the liquid exits the bayonet into the evaporator core, most of the liquid wets the primary wick structure 211 and the secondary wick structure 212. The excess liquid goes back to the compensation chamber 25 through the non-wick flow path 214. The condenser 23 is connected to or near to a heat sink 93 such as cooling sheet.

When the evaporator 21 is connected to or closed to an external heat source 91, the evaporator 21 will absorb the heat from the external heat source 91 and causes the internally-stored condensate 262 to evaporate as the vapor 261. Furthermore, the vapor 261 flows along the vapor line 231 because of the pressure gradient. When reaching the condenser 23, the vapor emits the heat because of the influence of the heat sink 93, and condenses as the condensate 262 again. When the loop heat pipe (LHP) is operating, the flow in the LHP is driven by surface tension developed in the capillary of the primary wick structure 211. Menisci form at the outer surface of the primary wick structure 211. The capillary action draws the liquid at the inner surface of the primary wick structure 211 to the outer surface of the primary wick structure 211. The liquid is then vaporized across the meniscus and gains the pressure, required as the pumping force to drive the whole system. The compensation chamber 25 is used for storing the excess condensate 262, and for adjusting the amount of the working fluid under the different intensities of the external heat source 91 in all circulation system.

The above heat pipe evaporators in the prior art are all cylinders. With regard to the plate heat source such as electronic chips, etc., the heat pipe evaporator needs the switching element to switch a cylinder to a plate benefit for the heat dissipation design of the plate heat source. Such a design increases the uncertainty of the switching element, and increases the thermal resistance so as to influence the efficiency of heat conductivity.

It is therefore attempted by the applicant to deal with the above situation encountered in the prior art.

SUMMARY OF THE INVENTION

In accordance with one aspect of the present invention, a heat dissipation system is provided. The heat dissipation system includes: an evaporator having a first wick structure; a vapor line connected to the evaporator for transporting a vapor from the evaporator; a condenser connected to the vapor line for condensing the vapor as a condensate; and a liquid line having a second wick structure and connected to the evaporator and the condenser. The liquid line is connected to the vapor line through the evaporator and the condenser, the condensate is transported to the evaporator through the liquid line, and the condensate in the evaporator is transformed into the vapor by an external heat source.

Preferably, the evaporator is a plate chamber.

Preferably, the condensate is transported to the evaporator by a capillary force of the first and the second wick structures.

Preferably, the first wick structure has a plurality of pore sizes.

Preferably, the first wick structure is arranged close to the external heat source and along an interior side of the plate chamber.

Preferably, the first wick structure is arranged along an interior upper side and an interior lower side of the plate chamber, and a relatively small pore size part of the first wick structure is arranged along the interior lower side of the plate chamber.

Preferably, the evaporator includes a compensation chamber neighboring a relatively large bore size part of the first wick structure for adjusting an amount of the condensate according to a dissipation power.

Preferably, the evaporator includes a vapor channel neighboring the first wick structure and connected to the vapor line for collecting and transporting the vapor to a vapor-collecting tank and the vapor line.

Preferably, the vapor channel is arranged close to the external heat source and along an interior side of the plate chamber and is extended into the first wick structure.

Preferably, the vapor channel in an interior of the plate chamber is arranged between the first wick structure and the plate chamber and is extended into the first wick structure.

Preferably, the second wick structure is arranged at one end close to the evaporator of the liquid line.

Preferably, the second wick structure is extended into the evaporator and is connected to the first wick structure.

Preferably, the first wick structure is made of one selected from a group consisting of a wire-mesh, a metal sinter, a ceramic, a porous plastic, a wall groove and a combination thereof.

Preferably, the second wick structure is made of one selected from a group consisting of a wire-mesh, a metal sinter, a ceramic, a porous plastic, a wall groove and a combination thereof.

In accordance with another aspect of the present invention, a heat dissipation system is provided. The heat dissipation system includes: a plate chamber having a first wick structure with a plurality of pore sizes; a vapor line having one end connected to the plate chamber for transporting a vapor from the plate chamber; a condenser connected to another end of the vapor line for condensing the vapor as a condensate; and a liquid line connected to the plate chamber and the condenser. The liquid line is connected to the vapor line through the plate chamber and the condenser, and the condensate is transported to the plate chamber through the liquid line by a capillary force of the first wick structure and is transformed into the vapor by an external heat source.

Preferably, the plurality of pore sizes of the first wick structure are changed according to a normal direction of a plate of the plate chamber.

Preferably, the first wick structure is arranged nearby the external heat source and along an interior side of the plate chamber, and a relatively small pore size part of the first wick structure is arranged close to a sidewall of the plate chamber for providing a preferred capillary force.

Preferably, the first wick structure is arranged along an interior upper side and an interior lower side of the plate chamber, and a relatively small pore size part of the first wick structure is arranged close to the interior lower side of the plate chamber.

Preferably, the plate chamber includes a compensation chamber neighboring a relatively large pore size part of the first wick structure for adjusting an amount of the condensate according to a dissipation power.

Preferably, the liquid line includes a second wick structure.

Preferably, the second wick structure is arranged at one end of the liquid line close to the plate chamber.

Preferably, the second wick structure is extended into the plate chamber.

Preferably, the plate chamber includes a vapor channel neighboring the first wick structure and connected to the vapor line for collecting the vapor both in the first wick structure and the vapor channel and transporting the vapor to a vapor-collecting tank and the vapor line.

Preferably, the vapor channel is arranged between the first wick structure and the plate chamber and is extended into the first wick structure.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
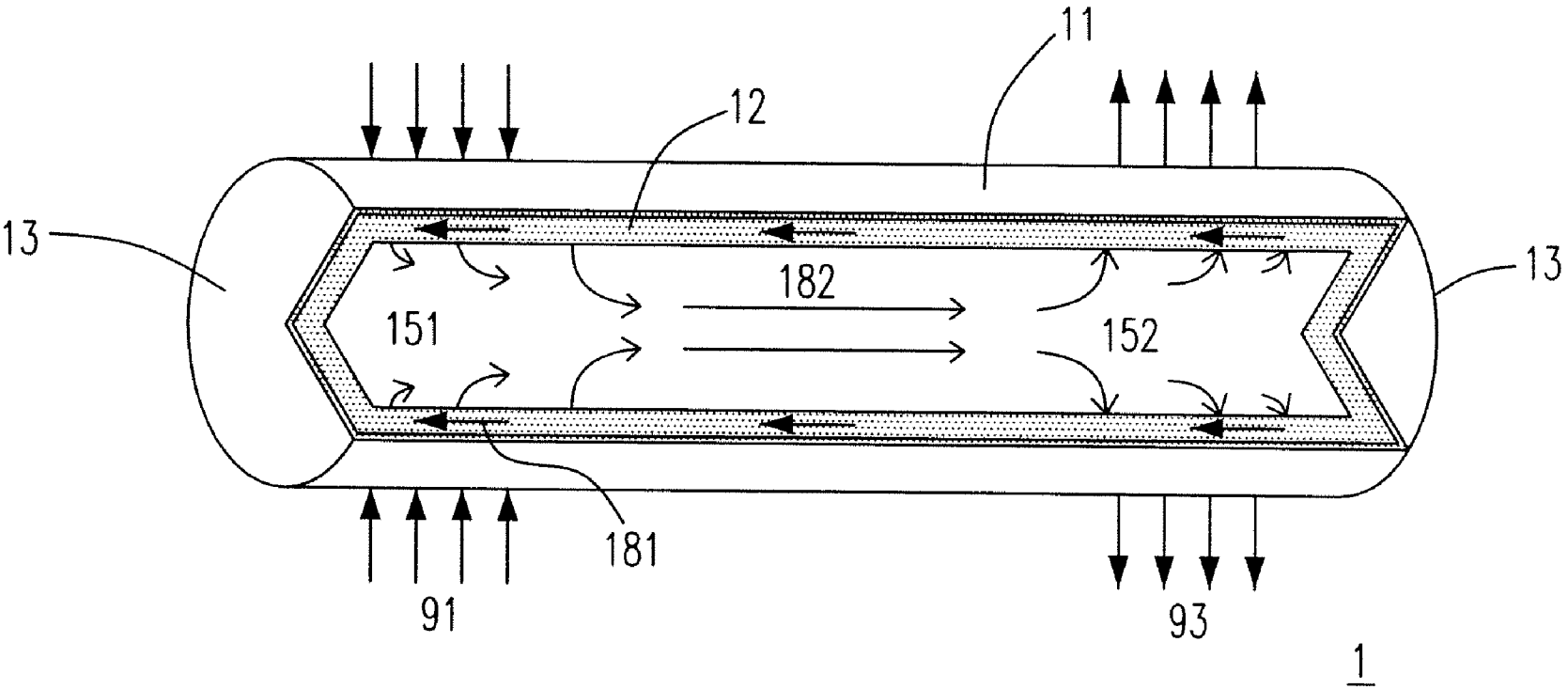
Fig. 1 (PRIOR ART)
FIG. 1 is a structural diagram showing a traditional heat pipe device in accordance with the prior art.
Figure 2A:
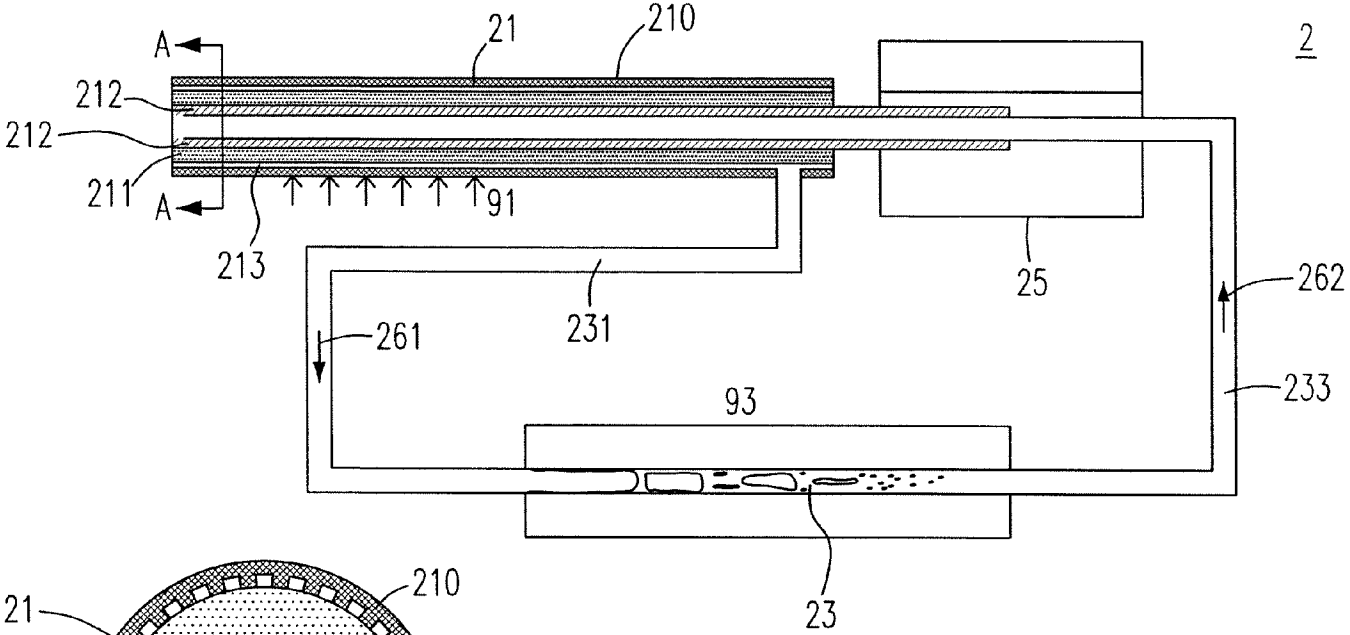
Fig. 2(A)(PRIOR ART)
FIG. 2(A) and FIG. 2(B) the structural diagrams showing a loop heat pipe device in accordance with the prior art.
Figure 2B:
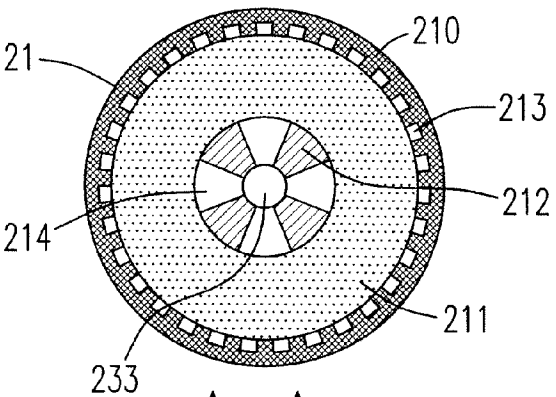
Fig. 2(B)(PRIOR ART)
Figure 3A:
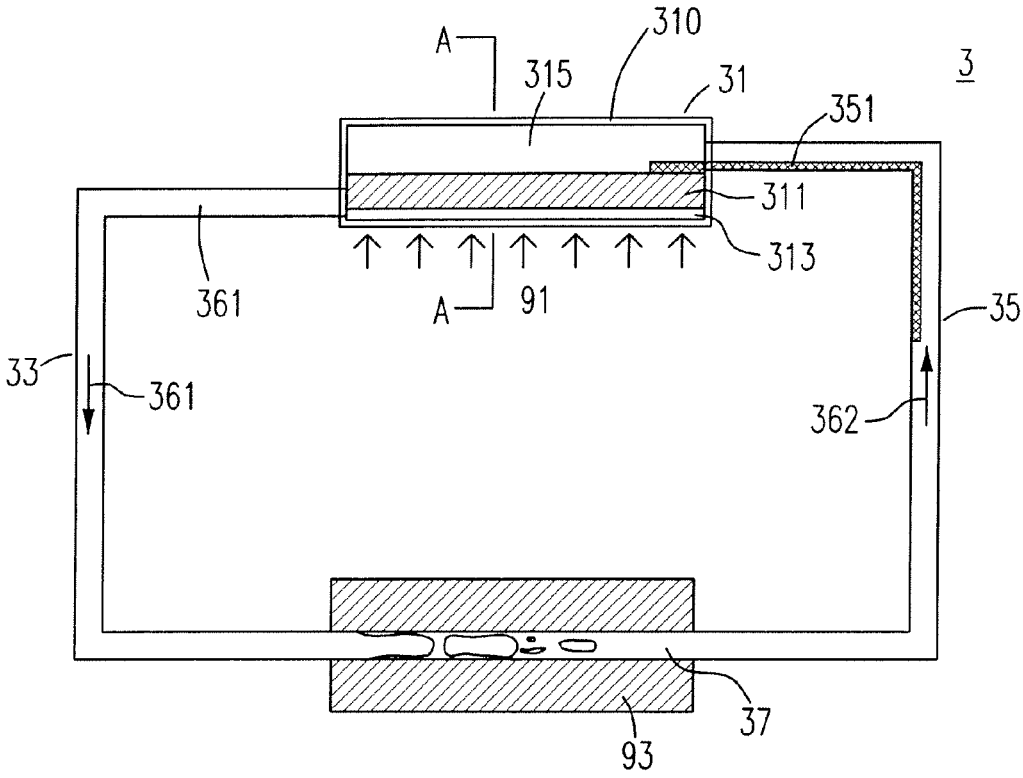
FIG. 3(A) and FIG. 3(B) are the structural diagrams showing a heat dissipation system in accordance with the first preferred embodiment of the present invention.
Figure 3B:
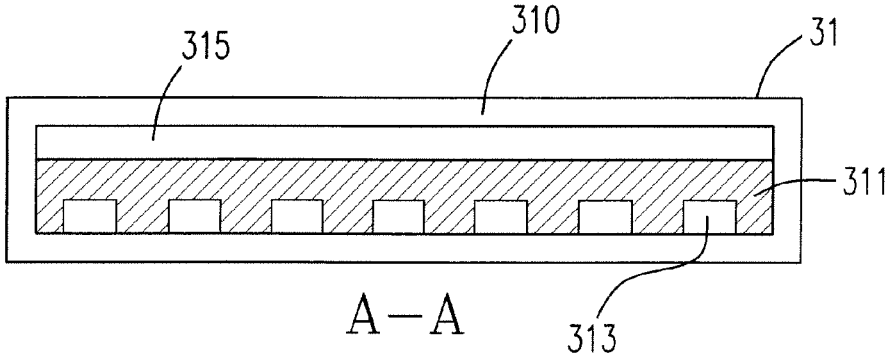

Please refer to FIG. 3(A) and FIG. 3(B), which are the structural diagrams showing a heat dissipation system in accordance with the first preferred embodiment of the present invention. In FIG. 3(A) and FIG. 3(B), a heat dissipation system 3 includes an evaporator 31, a vapor line 33, a liquid line 35 and a condenser 37, wherein the evaporator 31 is a plate chamber 310 configured by the upper lid and the lower lid. In general, the plate chamber 310 is made of the metal alloy with good thermal conductivity, for approaching or connecting to an external heat source 91 and sustaining the heat of the external heat source 91. The plate chamber 310 includes a first wick structure 311, a vapor channel 313 and a compensation chamber 315. After pumped to the vacuum, an easily-evaporated liquid under a low pressure is injected into the plate chamber 310 being a condensate 362. The vapor channel 313 is a set of interlinked channel disposed between the first wick structure 311 and the sidewall of plate chamber 310 which is near to the external heat source 91. The vapor channel 313 can be disposed above the lower lid or beneath the first wick structure 311 to be formed integratedly therewith, for collecting a vapor 361 generated after the condensate 362 is heated.

The vapor line 33 is connected to the evaporator 31, and is interlinked with the vapor channel 313, for transporting the vapor 361 from the evaporator 31. The condenser 37 is connected to the other end of the vapor line 33, and is approached or connected to an external heat sink 93, such as cooling sheet, etc., for releasing the heat from the vapor 361 of the vapor line 33 and condensing as a liquid condensate 362.

The liquid line 35 is interlinked with the condenser 37 and the evaporator 31 respectively. The end internal of the liquid line 35 close to the evaporator 31 has a second wick structure 351. The second wick structure 351 can also be extended into the evaporator 31 and is connected to the first wick structure 311. The condensate 362 condensed in the condenser 37 passes through the liquid line 35 and returns to the evaporator 31. Then the condensate 362 is heated in the evaporator 31 and is evaporated as the vapor 361. Finally, a circulation is formed. The heat in the external heat source 91 is transported to the external heat sink 93 continuously by interchanging the liquid phase and the vapor phase in the circulation. The compensation chamber 315 in the evaporator 31 is disposed to store adequate amount of the condensate 362, for adjusting the amount of the condensate and gas pressure and obtaining the preferred heat conductive efficiency according to the heat load of different external heat sources 91.

In the abovementioned circulation, the whole system is driven mainly depending on the heat provided by the external heat source 91 and the capillary force of the first wick structure 311. When the condensate 362 adhered on the first wick structure 311 is heated to evaporate, because of the action of the capillary force, the pores remaining in the first wick structure 311 will generate the capillary force continuously to the condensate 362 in the liquid line 35, and will make the condensate 362 enter the first wick structure 311 continuously. The vapor 361 is generated in the vapor channel 313 because the condensate 362 is heated. Then, the vapor 361 causes the pressure in the vapor channel 313 to be higher than that in the interior of the vapor line 33. The vapor 361 is collected in the vapor channel 313 and moves to the vapor line 33 because of the gas pressure gradient. After passing through and arriving at the condenser 37, the vapor 361 is affected by the external heat sink 93, and the heat is released so as to condense as the condensate 362. The condensate 362 is introduced to the evaporator 31 to form a circulation by the capillary force generated from the first wick structure 311.

Figure 4A:
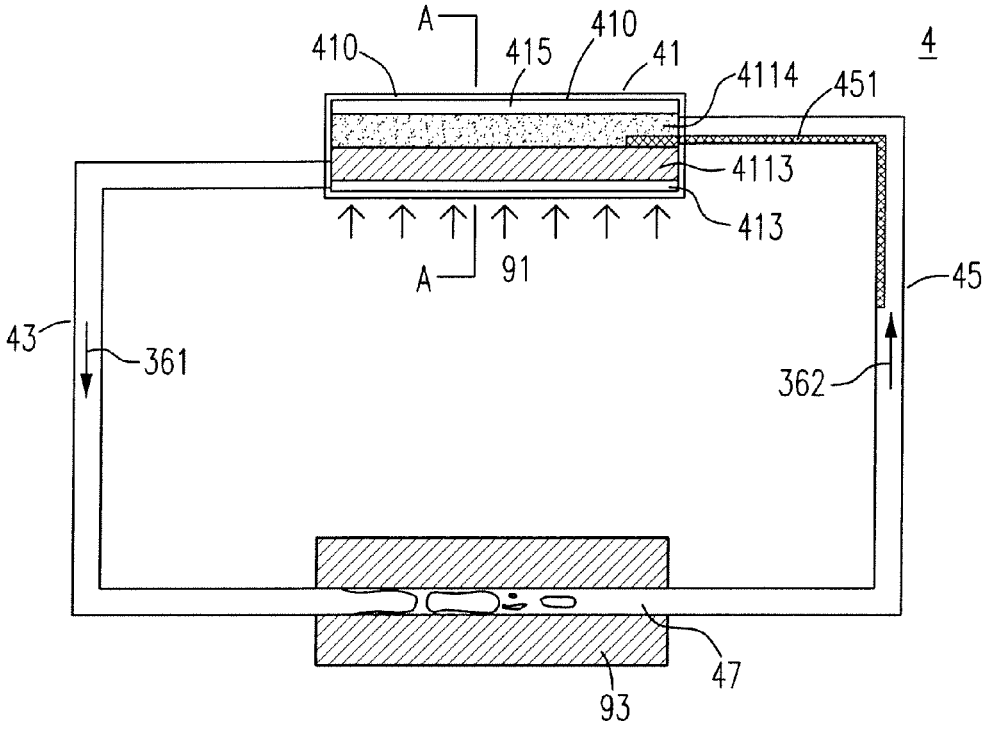
FIG. 4(A) and FIG. 4(B) are the structural diagrams showing a heat dissipation system in accordance with the second preferred embodiment of the present invention.
Figure 4B:
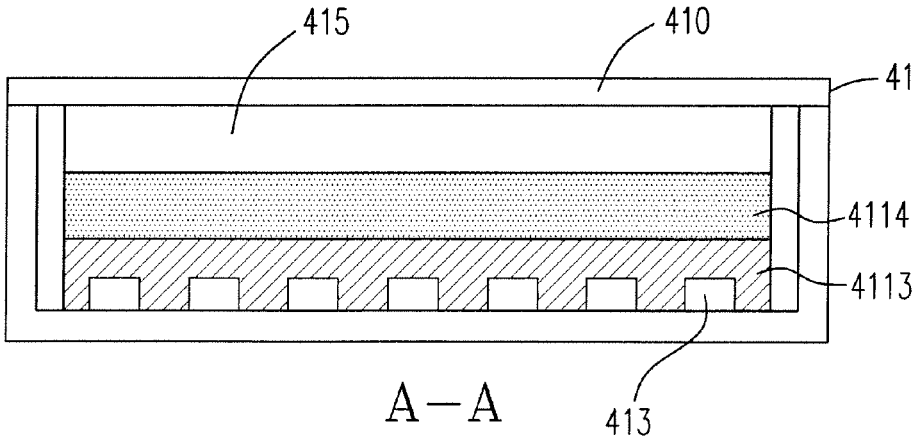

Please refer to FIG. 4(A) and FIG. 4(B), which are the structural diagrams showing a heat dissipation system in accordance with the second preferred embodiment of the present invention. In FIG. 4(A), a heat dissipation system 4 includes an evaporator 41, a vapor line 43, a liquid line 45 and a condenser 47, wherein the evaporator 41 is a plate chamber 410. The plate chamber 410 is configured by the upper lid and the lower lid, and is approached or connected to an external heat source 91 and sustains the heat of the external heat source 91. The plate chamber 410 includes a third wick structure 4113, a fourth wick structure 4114, a vapor channel 413 and a compensation chamber 415. After pumped to the vacuum, an easily-evaporated liquid under a low pressure is injected into the plate chamber 410 as a condensate 362. The third wick structure 4113 is distributed close to the heated surface of the evaporator 41, and has a relatively small pore size. For instance, the pore size of the third wick structure 4113 is about 10 micrometer (μm) in the general application. The fourth wick structure 4114 is distributed in a side far from the heated surface of the evaporator 41, and is connected to the compensation chamber 415 and the liquid line 45 respectively. The fourth wick structure 4114 has a relatively large pore size. For instance, the pore size of the fourth wick structure 4114 is about 100 μm in the general application. The vapor channel 413 is a set of interlinked channel distributed between the third wick structure 4113 and the sidewall of plate chamber 410 which is close to the external heat source 91. The vapor channel 413 can be disposed above the lower lid or beneath the third wick structure 4113, for collecting a vapor 361 generated after the condensate 362 is heated. A fifth wick structure 451 can also be disposed in the liquid line 45 to maintain the liquid line 45 moist, and to assist the condensate 362 in returning to the evaporator 41 by the capillary force.

When the heat is inputted through an external heat source 91 to the evaporator 41, a vapor 361 is generated from the condensate 362 in the vapor channel 413, and is introduced into the vapor line 43. When the vapor 361 passes through the condenser 47, the heat is brought away and the vapor 361 is condensed as the liquid-phase condensate 362. The condensate 362 passes through the liquid line 45 and returns to the fourth wick structure 4114 of the evaporator 41. Finally, the condensate 362 returns to the third wick structure 4113 and is heated to evaporate once again. The capillary force, which is generated after the condensate 362 is evaporated in the third wick structure 4113, is the main power to drive the circulation of the circuit. Therefore, the third wick structure 4113 with a relatively small pore size is adopted to generate stronger capillary force. The fourth wick structure 4114 with a relatively large pore size is adopted to obtain the smaller flow resistance, and the adequate capillary force of the fourth wick structure 4114 is provided to conserve the condensate 362 so as to stabilize the circulation.

Because of the characteristics of the low flow resistance and the water conservation of the relatively large pore size of the fourth wick structure 4114, the fourth wick structure 4114 is suitable to substitute for the function of the compensation chamber 415. Therefore, the fourth wick structure 4114 can also be completely distributed in the area of the original compensation chamber 415. In other words, the evaporator 41 is gradient-filled by the different pore sizes of the wick structures (4113, 4114, 451), wherein one end close to the external heat source 91 is the relatively small pore size, and the other end close to the liquid line 45 is the relatively large pore size. The wick structure more than two pore sizes can also be adopted. Especially, the gradually pore sizes of the wick structure can be sintered one time by the metal sintering technology nowadays. Here, the wick structure (4113, 4114, 451) can be adopted adequately to increase the efficiency of system.

Please refer to FIG. 5(A) to FIG. 5(I), which are the structural diagrams showing an evaporator of a heat dissipation system in accordance with the third preferred embodiment of the present invention. FIG. 5(A) to FIG. 5(I) are the detail composition figures of the round plate evaporator 61 of the present invention, and the round plate evaporator 61 can be substituted for the evaporators (31, 41) of the abovementioned first embodiment and the second embodiment respectively.

Figure 5A:
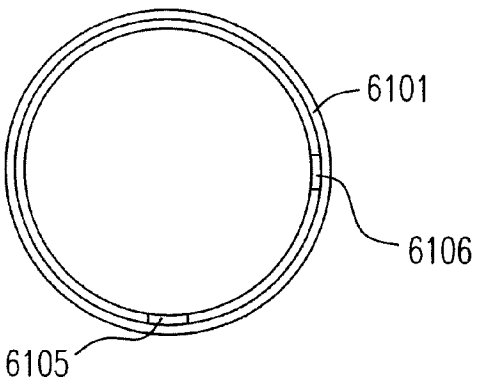
FIG. 5(A) to FIG. 5(I) are the structural diagrams showing an evaporator of a heat dissipation system in accordance with the third preferred embodiment of the present invention.
Figure 5B:
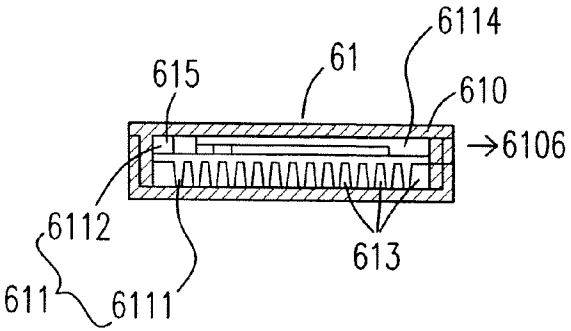
Figure 5C:
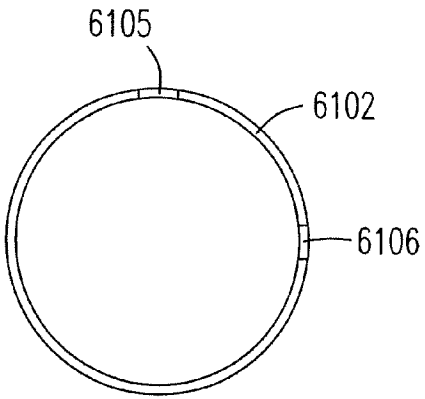

In FIG. 5(A) to FIG. 5(I), FIG. 5(B) is the cross section of the round plate evaporator 61. The shell 610 of the round plate evaporator 61 is configured by an upper lid 6101 and a lower lid 6102. FIG. 5(A) is the top view of the upper lid 6101, and FIG. 5(C) is the top view of the lower lid 6102. The shell 610 has an opening 6105 for connecting to a vapor line (not shown in the figure), and has an opening 6106 for connecting to a liquid line (not shown in the figure). The interior of the round plate evaporator 61 includes a sixth wick structure 6111 and a seventh wick structure 6112, wherein the sixth wick structure 6111 is configured in the lower side of the round plate evaporator 61. The sixth wick structure 6111 is approached to the end of the external heat source (not shown in the figure). The seventh wick structure 6112 is piled up on the sixth wick structure 6111.

Figure 5D:
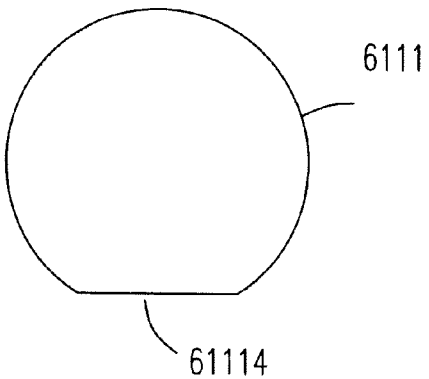
Figure 5E:
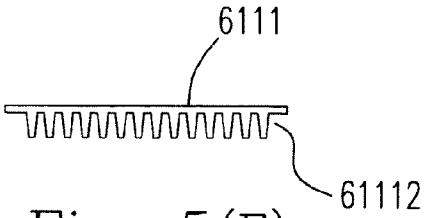
Figure 5G:
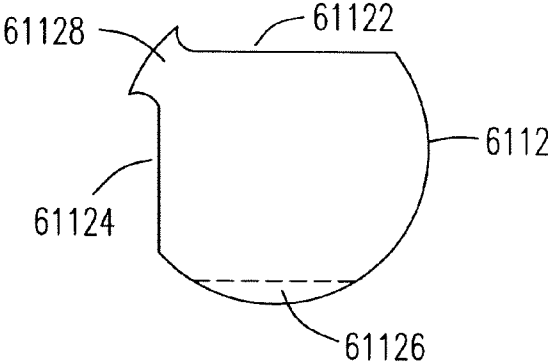
Figure 5I:
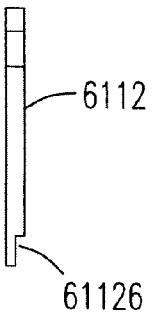
Figure 5F:
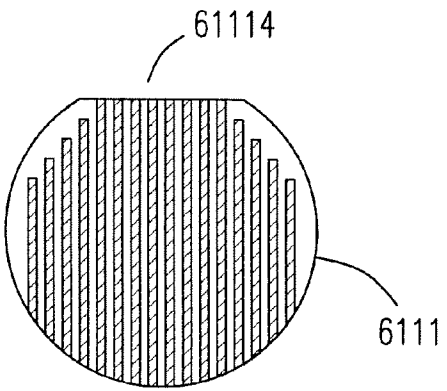

The top view, the cross section and the bottom view of the sixth wick structure 6111 respectively are represented in FIG. 5(D), FIG. 5(E) and FIG. 5(F). An grooved structure 61112 is disposed under the sixth wick structure 6111, and a vapor channel 613 is formed between the grooved structure 61112 and the shell 610. A gap 61114 formed in the sixth wick structure 6111 and the leak 61126 of the sixth wick structure 6111 are piled up each other and are jointly formed a vapor-collecting tank (not shown in the figure). The vapor channel 613 can be utilized for collecting the vapor, which is generated from the condensate heated by the external heat source, of the interior of the shell 610 and the sixth wick structure 6111. The vapor is introduced into the vapor-collecting tank and then is introduced into the vapor line.

Figure 5H:
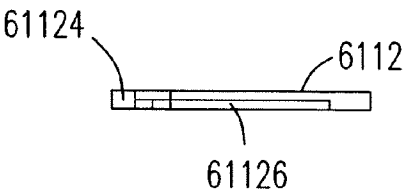

The top view, the cross section and the lateral view of the seventh wick structure 6112 respectively are represented in FIG. 5(G), FIG. 5(H) and FIG. 5(I). The space formed between the gap 61122 of the upper side of the seventh wick structure 6112 and the shell 610, and the space formed between the gap 61124 of the lower side of the seventh wick structure 6112 and the sixth wick structure 6111 can be a compensation chamber 6114, for adjusting the amount of the condensate in all the heat dissipation system according to the heat dissipation power.

The abovementioned sixth wick structure 6111 is configured by adopting the wick material with a relatively small pore size. For instance, the pore size of the sixth wick structure 6111 is ranged about 1~20 μm for providing the preferred capillary force so as to drive the operation of the two-phase circulation system of heat dissipation. The seventh wick structure 6112 is configured by adopting the wick material with a relatively large pore size. For instance, the pore size of the seventh wick structure 6112 is ranged about 50~200 μm. The smaller flow resistance of the seventh wick structure 6112 can make the condensate easily circulate so as to enter into the sixth wick structure 6111. The smaller flow resistance thereof also provides adequate capillary force to conserve the condensate so as to stabilize the circulation.

In the abovementioned FIG. 5(A) to FIG. (I), a layer of the wick structure identical with the sixth wick structure 6111 is added on the seventh wick structure 6112 in the reversed direction. The upper side and the lower side in the evaporator 61 both have wick structures, and the vapor channel 613 is increased so as to drain the vapor.

The abovementioned wick structures (6111, 6112) are all made of structures that the capillary force can be generated, such as wire-mesh sheet, metal sintering, ceramic material, porous plastic material and wall grooved, etc. The structure can also be the combination of the abovementioned materials.

The main differences between the present invention and the traditional loop heat pipe structure lie in that (1) the traditional cylinder-shaped evaporator is substituted for the plate evaporator, and the buffer tank is directly disposed in the plate evaporator benefit for simplifying the structure and easily utilizing the space; and (2) a wick structure is disposed close to the end of the evaporator in the liquid line, and the multiple-layered structures with different pore sizes are adopted in the evaporator so as to enormously decrease the turning-on temperature of the plate evaporator.

When a loop heat pipe of the plate evaporator is inputted in the low power, because of the heat conductivity effect and approaching to the external heat source, the vaporization phenomenon is generated in the liquid line of the plate evaporator close to the evaporator in the beginning of inputting the heat source. The vaporization phenomenon will generate a negative-directional gas pressure in the two-phase circulation system so as to uneasily turn on the circulation. Even, since the condensate is evaporated continuously internal the liquid line, the vaporization phenomenon might lead to dry out so as to inactivate the heat dissipation system. However, in the present invention, the wick structure disposed in the liquid line close to the evaporator can maintain the liquid line close to the evaporator moist continuously, and can assist the condensate in returning to the evaporator by the capillary force of the wick structure. The turning-on temperature of the heat dissipation is decreased enormously.

Figure 6A:
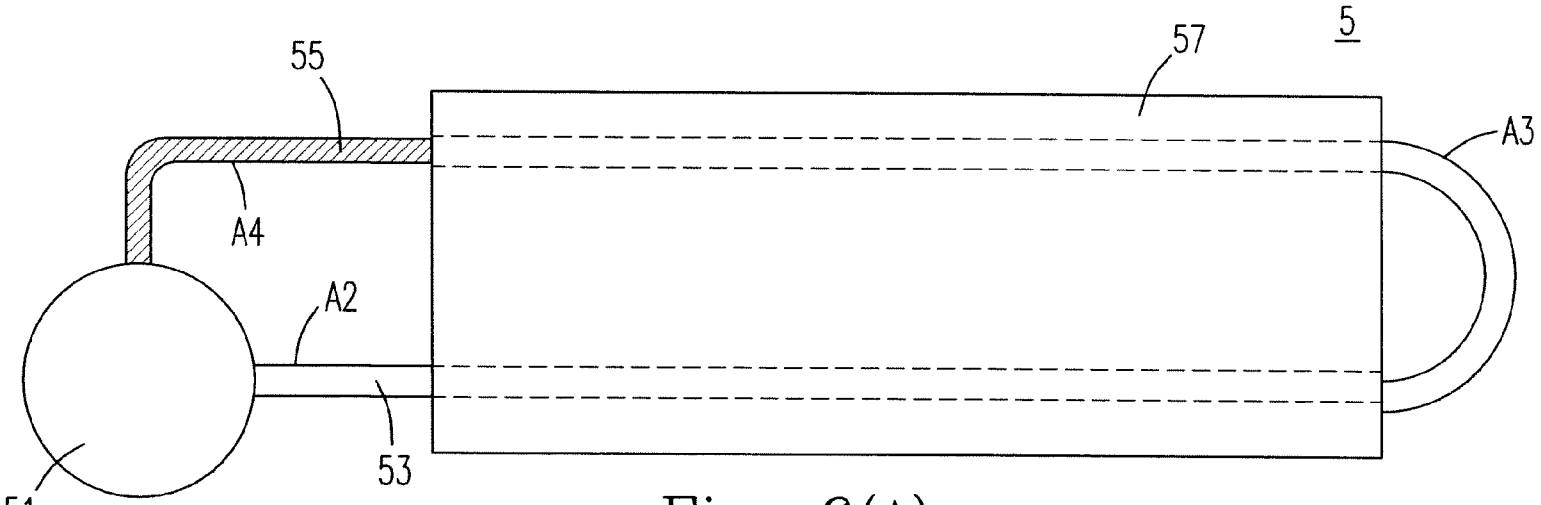
FIG. 6(A) and FIG. 6(B) are the diagrams showing an effect calculation of a loop heat dissipation system with a plate evaporator of the present invention.
Figure 6B:
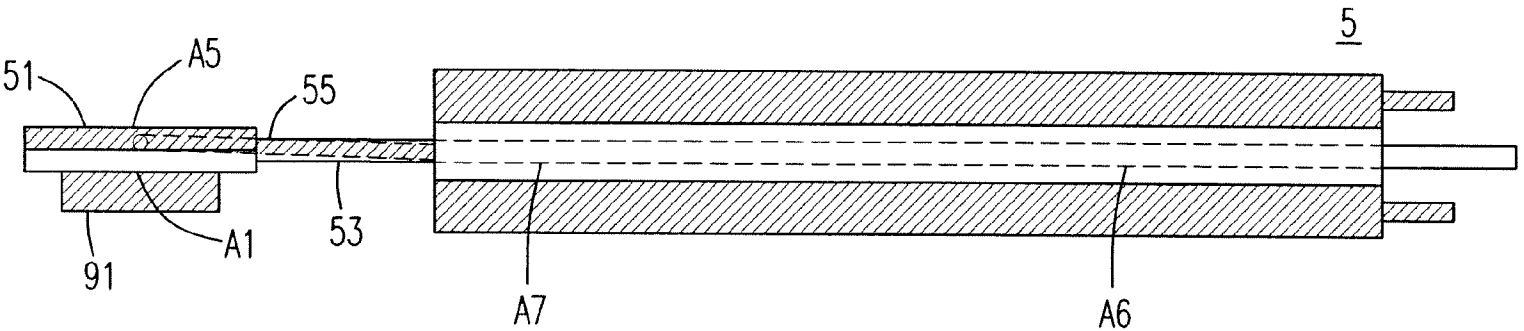

Please refer to FIG. 6(A) and FIG. 6(B), which are the diagrams showing an experiment apparatus of a loop heat dissipation system with a plate evaporator of the present invention. In FIG. 6(A) and FIG. 6(B), a loop heat dissipation system with a plate evaporator 5 includes a round plate evaporator 51, a vapor line 53, a liquid line 55 and a condenser 57. The temperature variations along with time at the measuring points Ai (i=1~7) of the heat dissipation system 5 are measured.

Figure 7:
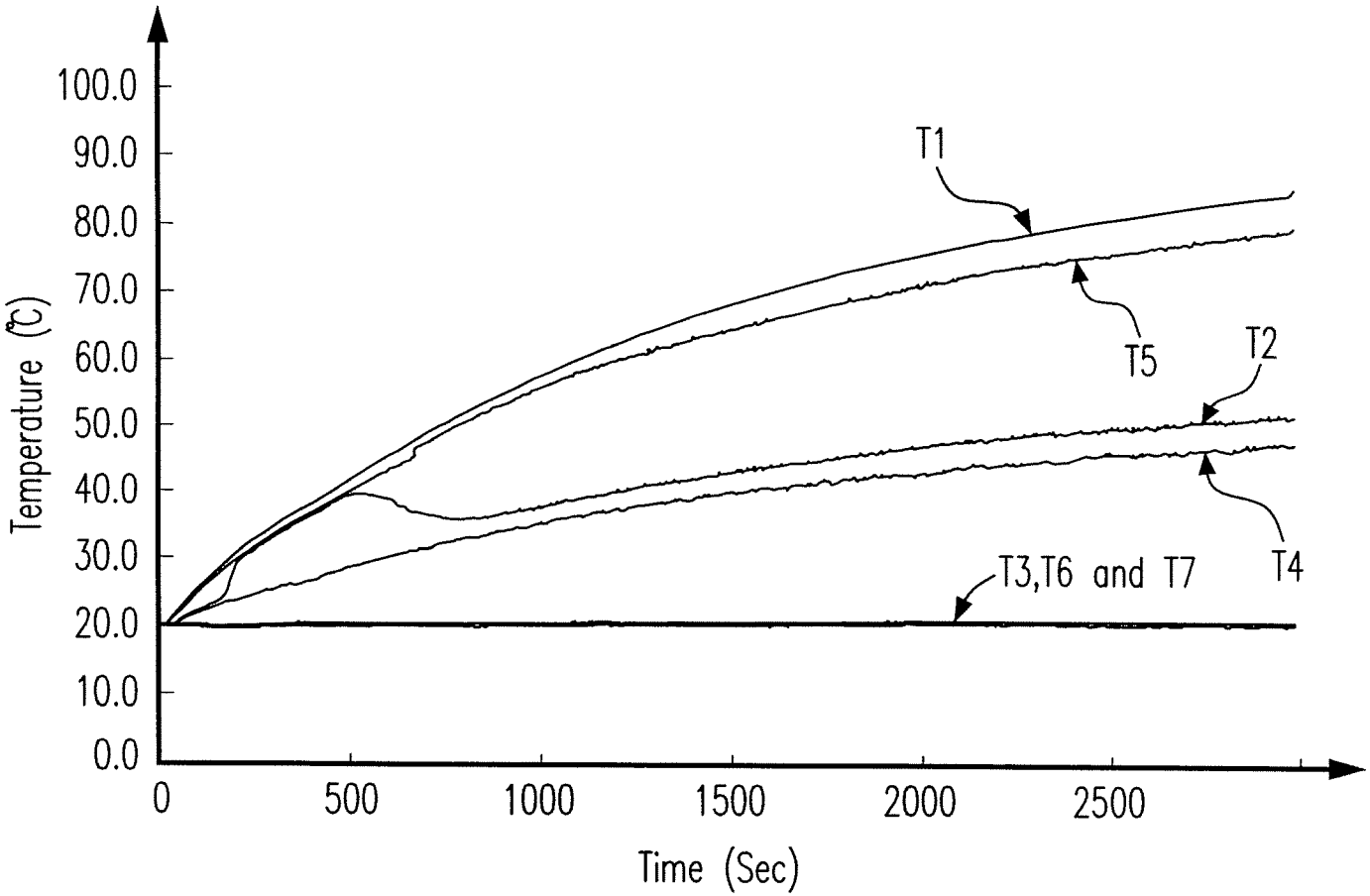
FIG. 7 is a diagram showing the temperature and time relationship of a loop heat dissipation system with a plate evaporator of the present invention, wherein there is without any second wick structure disposed in the liquid line, and the input power is 15 watts (W).

Please refer to FIG. 7, which is a diagram showing the temperature and time relationship of a loop heat dissipation system with a plate evaporator of the present invention, wherein there is without any second wick structure disposed in the liquid line, and the input power is 15 watts (W). The temperature curves Ti (i=1~7) respectively labeled in FIG. 7 are the temperatures measured at the measuring points Ai (i=1~7) of the loop heat dissipation system with a plate evaporator 5. The temperatures of each measuring point in FIG. 7 are ranked from up to down as T1, T5, T2, T4, T3, T6 and T7 according to the temperatures. It is known from the temperature curves in FIG. 7, the loop heat dissipation system with a plate evaporator 5 fails to turn on at 15 W of the low-watt inputting power. The temperatures everywhere in the loop heat dissipation system with a plate evaporator 5 are increased continuously with time, and a stable status is not achieved.

Figure 8:
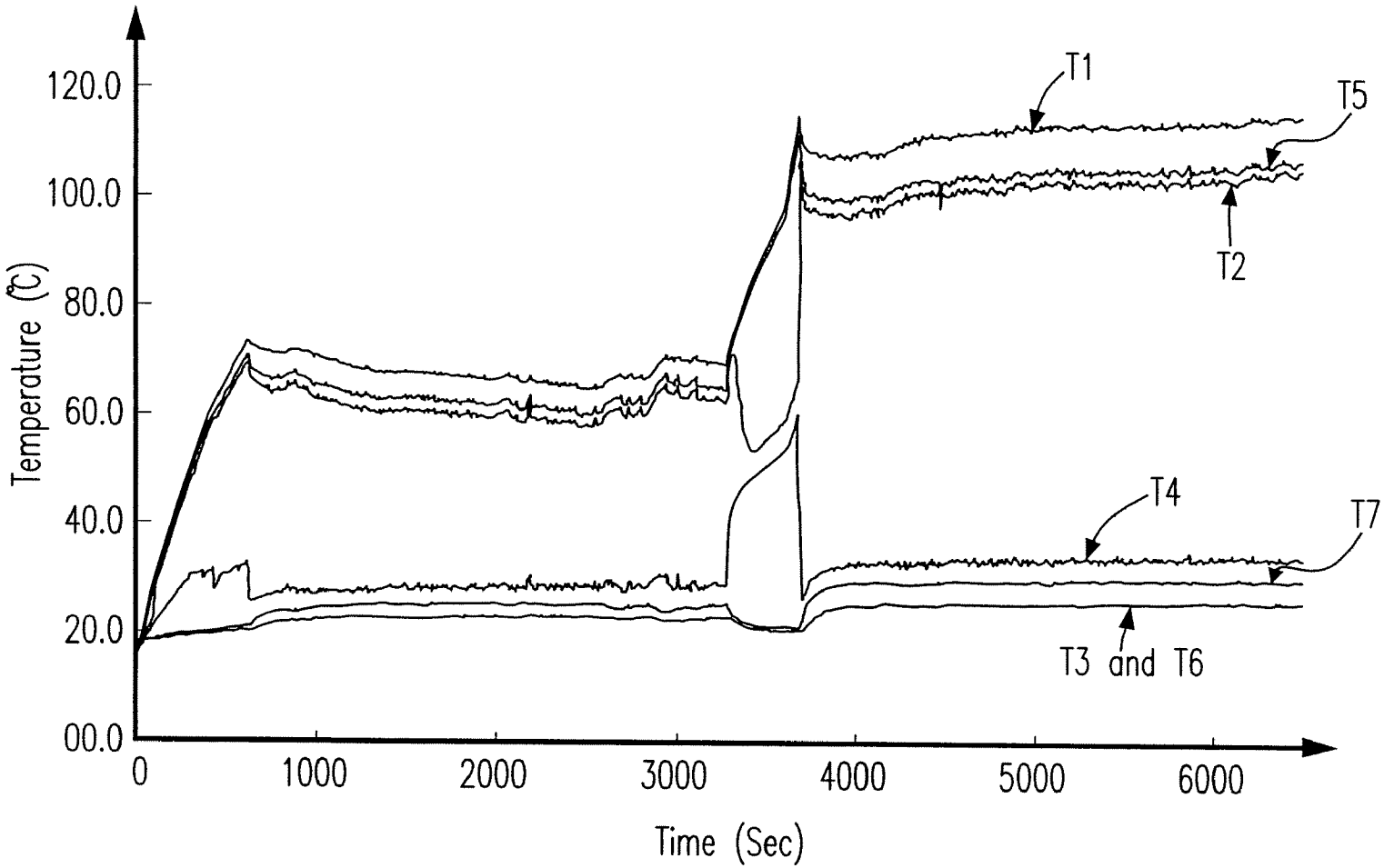
FIG. 8 is a diagram showing the temperature and time relationship of a loop heat dissipation system with a plate evaporator of the present invention, wherein there is without any second wick structure disposed in the liquid passage, and the inputting power is 35 W in the beginning, and then is adjusted to 70 W after one hour.

Please refer to FIG. 8, which is a diagram showing the temperature and time relationship of a loop heat dissipation system with a plate evaporator 5 according to FIG. 6 of the present invention, wherein there is without any second wick structure disposed in the liquid line 55, and the inputting power is 35 W in the beginning, and then is adjusted to 70 W after one hour. The temperature curves Ti (i=1~7) respectively labeled in FIG. 8 are the temperatures measured at the measuring points Ai (i=1~7) of the loop heat dissipation system with a plate evaporator 5. The temperatures of each measuring point in FIG. 8 are ranked from up to down as T1, T5, T2, T4, T7, T3 and T6 according to the temperatures. In FIG. 8, when the loop heat dissipation system with a plate evaporator 5 is at 35 W of the heat source inputting power, the loop heat dissipation system with a plate evaporator 5 can be turned on at 72° C. When the heat source inputting power is at 35 W and 70 W, the system temperatures maintain at 60~70° C. and 97~115° C. respectively.

Figure 9:
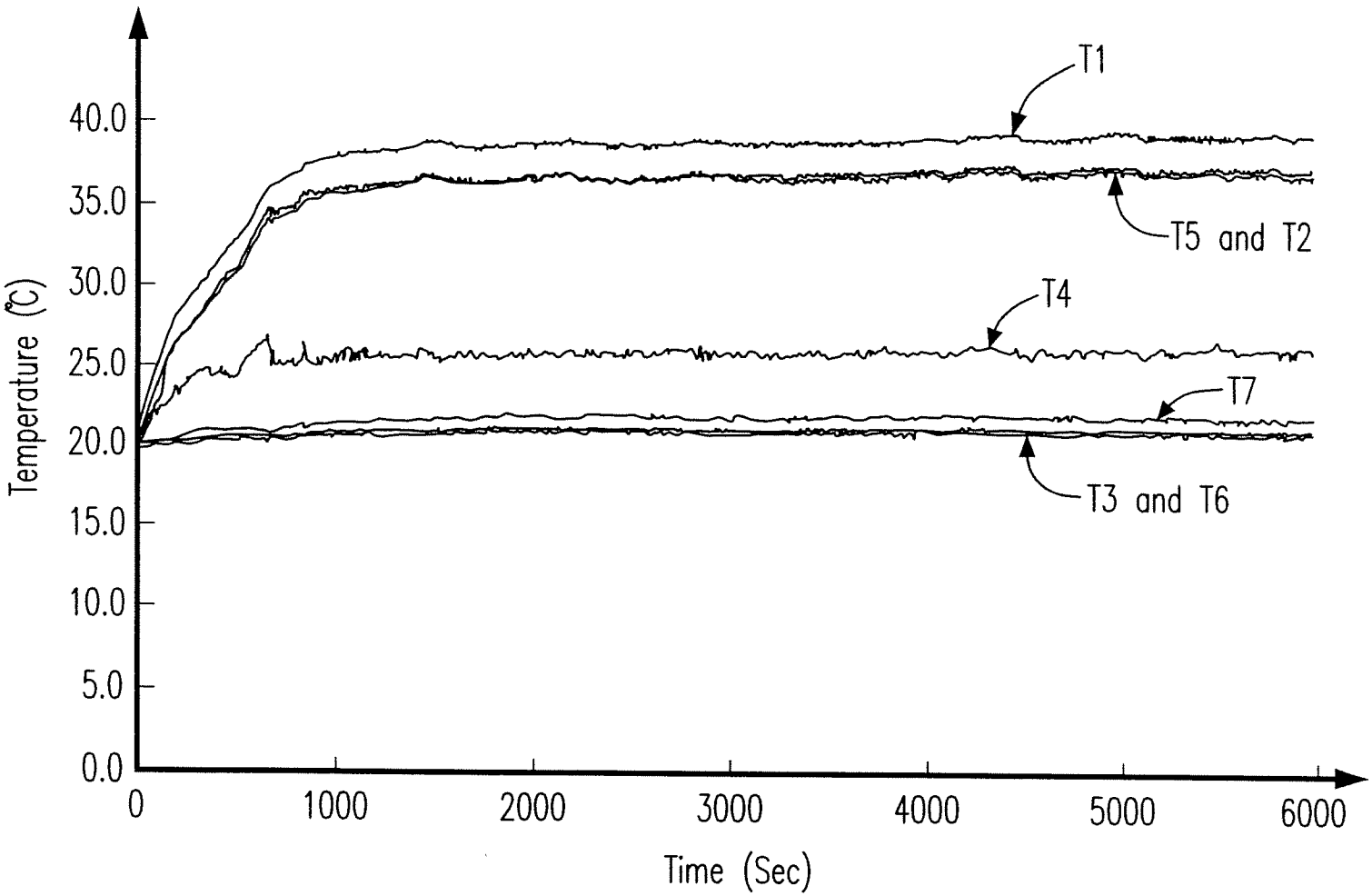
FIG. 9 is a diagram showing a temperature and time relationship of a loop heat dissipation system with a plate evaporator according to FIG. 6 of the present invention, wherein a second wick structure is disposed in the end of the liquid line close to the evaporator, and the inputting power is 10 W.

Please refer to FIG. 9, which is a diagram showing the temperature and time relationship of a loop heat dissipation system with a plate evaporator according to FIG. 6 of the present invention, wherein a second wick structure (not shown in FIG. 6) is disposed in the end of the liquid line 55 close to the evaporator 51, and the inputting power is 10 W. The temperature curves Ti (i=1~7) respectively labeled in FIG. 9 are the temperatures measured at the measuring points Ai (i=1~7) of the loop heat dissipation system with a plate evaporator 5. The temperatures of each measuring point in FIG. 9 are ranked from up to down as T1, T5, T2, T4, T7, T3 and T6 according to the temperatures. In FIG. 9, it is shown that when a second wick structure is disposed in the liquid line 55, even the heat source inputting power is only 10 W, the loop heat dissipation system with a plate evaporator 5 is turned on successfully and achieved the stable status, which means that the second wick structure overcomes the problem of the loop heat pipe which is turned on uneasily under the low heat source power.

Figure 10:
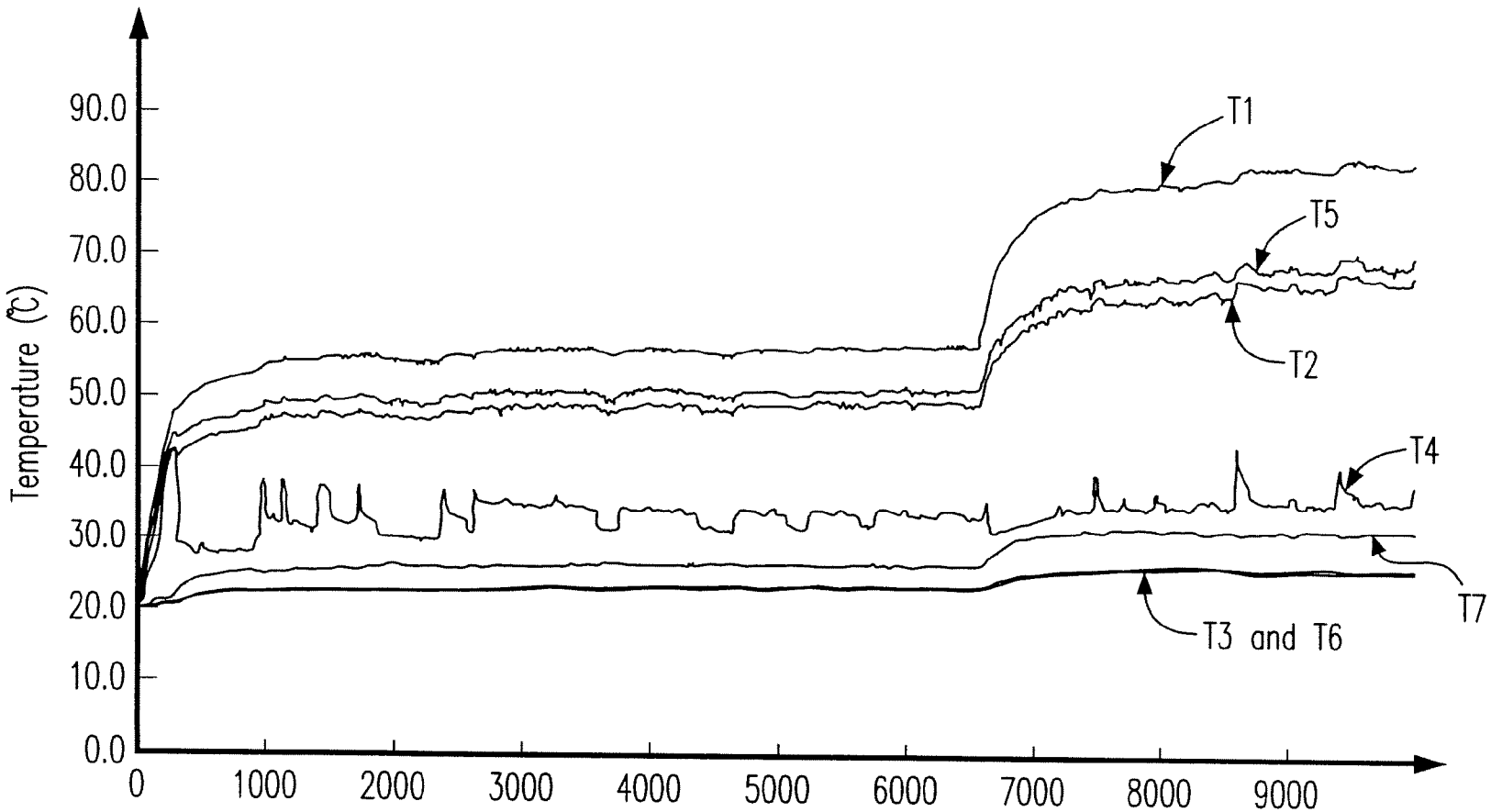
FIG. 10 is a diagram showing the temperature and time relationship of a loop heat dissipation system with a plate evaporator according to FIG. 6 of the present invention, wherein a second wick structure is disposed in the liquid passage, and the inputting power is 35 W in the beginning, and then is adjusted to 70 W after 110 minutes.

Please refer to FIG. 10, which is a diagram showing the temperature and time relationship of a loop heat dissipation system with a plate evaporator of the present invention, wherein a second wick structure is disposed in the liquid line 55, and the inputting power is 35 W in the beginning, and then is adjusted to 70 W after 110 minutes. The temperature curves Ti (i=1~7) respectively labeled in FIG. 10 are the temperatures measured in the measuring points Ai (i=1~7) of the heat dissipation system with a plate evaporator 5. The temperatures of each measuring point in FIG. 10 are ranked from up to down as T1, T5, T2, T4, T7, T3 and T6 according to the temperatures. Comparing the result of FIG. 10 with that of FIG. 8, it is found that when the heat source inputting power is 35 W and 70 W, the temperatures in the balance state which the second wick structure is disposed in the liquid line 55 of the loop heat dissipation system with a plate evaporator 5 all are lower than those in the balance state which there is without any second wick structure disposed in the loop heat dissipation system with a plate evaporator 5.

According to the diligent experiments done by the inventors, it is known that when a second wick structure is disposed in the liquid line of the loop heat dissipation system with a plate evaporator, the loop heat dissipation system is turned on successfully under the low heat source inputting power, and the turning-on temperatures and balancing temperatures of the system are efficiently decreased.

In conclusion, a practicable and operable heat dissipation system is provided in the present invention. The heat dissipation system has advantages of increasing heat dissipation efficiency, increasing space usefulness and decreasing the turning-on temperature of the heat dissipation system, etc.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A heat dissipation system, comprising:

an evaporator including a compensation chamber and a first wick structure having a plurality of pore sizes with a relatively large pore size part, wherein the compensation chamber neighbors the relatively large pore size part for adjusting an amount of a condensate according to a dissipation power;

a vapor line connected to the evaporator for transporting a vapor from the evaporator;

a condenser connected to the vapor line for condensing the vapor as the condensate; and a liquid line having at one end thereof a second wick structure close to the evaporator and connected to the first wick structure, wherein the liquid line is connected to the vapor line through the evaporator and the condenser, the second wick structure is extended from only part of the way along the liquid line from the evaporator to the condenser, the condensate is transported to the evaporator through the liquid line, and the condensate in the evaporator is transformed into the vapor by an external heat source.

2. The heat dissipation system according to claim 1, wherein the evaporator is a plate chamber.

3. The heat dissipation system according to claim 2, wherein the condensate is transported to the evaporator by a capillary force of the first and the second wick structures.

4. The heat dissipation system according to claim 3, wherein the first wick structure is arranged close to the external heat source and along an interior side of the plate chamber.

5. The heat dissipation system according to claim 3, wherein the first wick structure is arranged along an interior upper side and an interior lower side of the plate chamber, and a relatively small pore size part of the first wick structure is arranged along the interior lower side of the plate chamber.

6. The heat dissipation system according to claim 3, wherein the evaporator comprises a vapor channel neighboring the first wick structure and connected to the vapor line for collecting and transporting the vapor to a vapor-collecting tank and the vapor line.

7. The heat dissipation system according to claim 6, wherein the vapor channel is arranged close to the external heat source and along an interior side of the plate chamber and is extended into the first wick structure.

8. The heat dissipation system according to claim 6, wherein the vapor channel in an interior of the plate chamber is arranged between the first wick structure and the plate chamber and is extended into the first wick structure.

9. The heat dissipation system according to claim 1, wherein the second wick structure is extended into the evaporator.

10. The heat dissipation system according to claim 1, wherein the first wick structure is made of one selected from a group consisting of a wire-mesh, a metal sinter, a ceramic, a porous plastic, a wall groove and a combination thereof.

11. The heat dissipation system according to claim 1, wherein the second wick structure is made of one selected from a group consisting of a wire-mesh, a metal sinter, a ceramic, a porous plastic, a wall groove and a combination thereof.

12. A heat dissipation system, comprising:

a plate chamber having a compensation chamber and a first wick structure with a plurality of pore sizes being changed according to a normal direction of a plate of the plate chamber, the first wick structure being arranged nearby an external heat source and along an interior side of the plate chamber, wherein the first wick structure has a relatively small pore size part being arranged close to a sidewall of the plate chamber for providing a capillary force, and a relatively large pore size part neighboring the compensation chamber for adjusting an amount of a condensate according to a dissipation power;

a vapor line having one end connected to the plate chamber for transporting a vapor from the plate chamber;

a condenser connected to another end of the vapor line for condensing the vapor as the condensate; and a liquid line including at one end thereof a second wick structure close to the plate chamber and connected to the first wick structure, wherein the liquid line is connected to the vapor line through the plate chamber and the condenser, the second wick structure is extended from only part of the way along the liquid line from the evaporator to the condenser, and the condensate is transported to the plate chamber through the liquid line by the capillary force of the first wick structure and is transformed into the vapor by the external heat source.

13. The heat dissipation system according to claim 12, wherein the first wick structure is arranged along an interior upper side and an interior lower side of the plate chamber, and the relatively small pore size part of the first wick structure is arranged close to the interior lower side of the plate chamber.

14. The heat dissipation system according to claim 12, wherein the second wick structure is arranged at one end of the liquid line close to the plate chamber.

15. The heat dissipation system according to claim 12, wherein the second wick structure is extended into the plate chamber.

16. The heat dissipation system according to claim 12, wherein the plate chamber comprises a vapor channel neighboring the first wick structure and connected to the vapor line for collecting the vapor both in the first wick structure and the vapor channel and transporting the vapor to a vapor-collecting tank and the vapor line.

17. The heat dissipation system according to claim 16, wherein the vapor channel is arranged between the first wick structure and the plate chamber and is extended into the first wick structure.

* * * * *